US006267319B1

(12) United States Patent
Hoffmann et al.

(10) Patent No.: US 6,267,319 B1
(45) **Date of Patent: *Jul. 31, 2001**

(54) METHOD AND APPARATUS FOR ROLLING UP HOSE INTO AN EXPANDED HOSE COIL

(75) Inventors: Richard W. Hoffmann, 734 Ivy La., Paso Robles, CA (US) 93446-2317; Richard L. Garner, Winnemucca, NV (US)

(73) Assignee: Richard W. Hoffmann, Napa, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/178,297

(22) Filed: Oct. 23, 1998

Related U.S. Application Data

(60) Provisional application No. 60/071,718, filed on Jan. 16, 1998.

(51) Int. Cl.[7] ..... B65H 18/10; B65H 75/24; B65H 75/28

(52) U.S. Cl. ..... 242/532.6; 242/395; 242/396.4; 242/537; 242/546.1; 242/577

(58) Field of Search ..... 242/532.6, 530.1, 242/546.1, 537, 577, 577.2, 577.3, 395, 395.1, 396.2, 396.3, 396.4, 401, 399, 407.1; 137/355.26, 355.27, 355.28, 355.12

(56) References Cited

U.S. PATENT DOCUMENTS

| | | | | |
|---|---|---|---|---|
| 568,916 | * | 10/1896 | Morehead | 242/407.1 |
| 803,374 | * | 10/1905 | Volkerding et al. | 242/407.1 |
| 1,108,726 | * | 8/1914 | Eichhoff | 242/401 |
| 1,294,291 | * | 2/1919 | Magnusen | 242/577.2 |
| 1,943,512 | * | 1/1934 | Becker | 242/577 |
| 2,133,281 | * | 10/1938 | Coburn | 242/577 |
| 2,197,767 | * | 4/1940 | Neale | 242/395 |

(List continued on next page.)

OTHER PUBLICATIONS

Declaration of Richard W. Hoffmann, pp. 1 through 4 and Exhibit A and B.

C & S Supply, Catalog, "Providing You With Quality Affordable Products", undated, 3 pages with figures 1–8, pp. 38 with price list.

Justin Gnass & Co., "Finally! There's a Simple, Efficient Means to Reconfigure and Deploy GNASS Hose Packs in the Field", undated, one page.

(List continued on next page.)

*Primary Examiner*—John M. Jillions
(74) *Attorney, Agent, or Firm*—Edwin A. Suominen; Louis J. Hoffman

(57) ABSTRACT

A dual-mode hose roller including a crank and a mounting plate may be used to roll up collapsed hose into either a compact hose roll or an expanded hose coil. The crank and mounting plate are arranged to facilitate transmission of torque from the crank to the desired type of hose winding. When a compact hose roll is desired, torque is transmitted directly to the hose. When an expanded hose coil is desired, torque is transmitted to the hose through the mounting plate and several extension arms. The extension arms are sized so that the hose roller forms an expanded hose coil having a suitable diameter for structural fire hose. The mounting plate is rotatably mounted on a fixed support through a bearing and, optionally, a ratchet mechanism. Using the hose roller, preparation is made for fighting a structural fire arranging a section of collapsed hose into a hose bundle. A section of hose is rolled up into an expanded hose coil and arranged into a number of hose loops to form a hose bundle. The hose bundle may be stored in a box or hose compartment of a fire engine. When water pressure is applied to the hose bundle, it falls out of such a box to form an expanded hose coil.

22 Claims, 14 Drawing Sheets

U.S. PATENT DOCUMENTS

| | | | | |
|---|---|---|---|---|
| 2,221,265 | * | 11/1940 | Rinard et al. | 242/546.1 |
| 2,396,451 | * | 3/1946 | Warkentin | 242/532.6 |
| 2,454,870 | * | 11/1948 | Grisanti | 242/577 |
| 2,960,279 | * | 11/1960 | Little | 242/532.6 |
| 3,124,321 | * | 3/1964 | Rylott et al. | 242/532.6 |
| 3,168,260 | * | 2/1965 | Kittelson | 242/546.1 |
| 3,254,862 | * | 6/1966 | Bates et al. | 242/546.1 |
| 3,946,964 | | 3/1976 | Zinser . | |
| 4,006,948 | | 2/1977 | Kessinger . | |
| 4,018,242 | | 4/1977 | Schlegel . | |
| 4,106,714 | | 8/1978 | Janzen . | |
| 4,288,047 | | 9/1981 | Berry et al. . | |
| 4,311,288 | * | 1/1982 | Galland | 242/532.6 |
| 4,380,269 | | 4/1983 | Petaway et al. . | |
| 4,592,519 | | 6/1986 | Peacock . | |
| 4,732,345 | * | 3/1988 | Golden | 242/546.1 |
| 4,747,560 | | 5/1988 | Karlsson . | |
| 4,757,838 | | 7/1988 | McGullion . | |
| 4,979,693 | * | 12/1990 | Eberhardt et al. | 242/395 |
| 5,033,690 | | 7/1991 | McIver . | |
| 5,205,509 | | 4/1993 | Noggle . | |
| 5,421,533 | | 6/1995 | Scott et al. . | |
| 5,505,404 | * | 4/1996 | Dubreuil | 242/532.6 |
| 5,566,901 | | 10/1996 | Wilder . | |
| 5,636,808 | * | 6/1997 | Collin | 242/395 |
| 5,961,061 | * | 10/1999 | Stanley | 242/532.6 |
| 5,988,559 | * | 11/1999 | Gnass | 242/537 |

OTHER PUBLICATIONS

Justin Gnass & Co., Product Catalog entitled "Firefighting Products", undated, pp. 1 through 11 with accompanying price list and order form.

Unknown author, "Progressive Hose Lays: Using the Cleveland Style Hose Lead", undated, one page.

KMP Krumweide Miller Products Progressive Fire Service Tools, "Wildland Progressive Pack Instructions", undated, one page.

* cited by examiner

FIG. 8
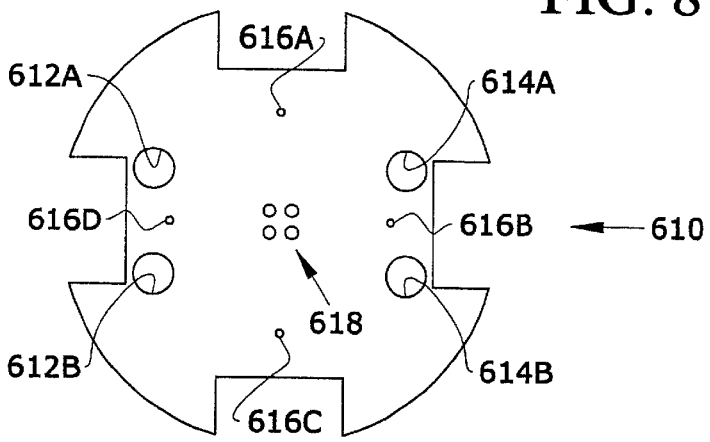
FIG. 9
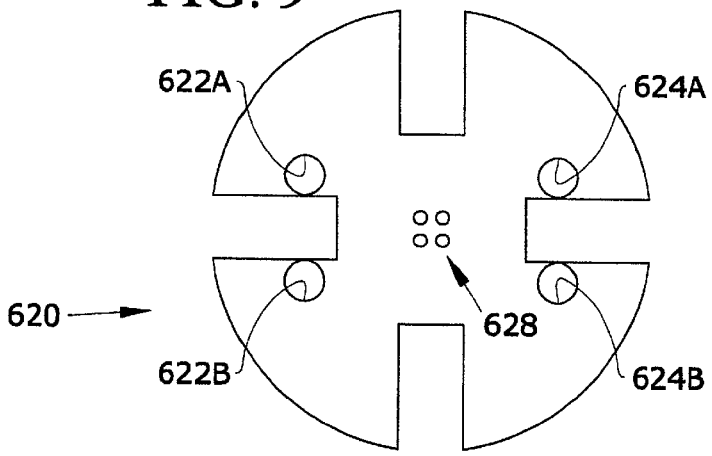
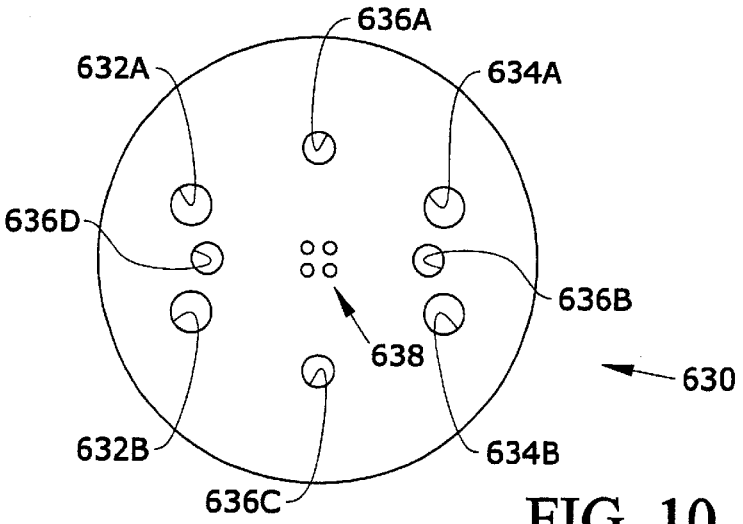
FIG. 10

METHOD AND APPARATUS FOR ROLLING UP HOSE INTO AN EXPANDED HOSE COIL

CROSS REFERENCE TO RELATED APPLICATIONS

The present application claims benefit of provisional application No. 60/071,718 filing date Jan. 16, 1998 of Richard W. Hoffmann, entitled "Apparatus to Enable Fire Hose to be Easily and Rapidly Wound and Compactly Stored for Automatic, Fully Charged Deployment in Fighting Fires in Tight Quarters," claimed for disclosure of exemplary embodiments of the present invention and not to limit the scope of any claim thereto.

FIELD OF THE INVENTION

This invention relates to methods and apparatus for rolling up and deploying collapsed hose. More particularly, the invention relates to methods and apparatus whereby lengths of hose are wound and stored to enable such hose to be readily deployed when water pressure is applied to the hose.

BACKGROUND OF THE INVENTION

A fire hose is conventionally deployed with some care before water pressure is applied to it. A tightly wound or improperly bundled hose tends to kink when water pressure is applied, cutting off the flow of water through the hose. Unfortunately, spreading out the hose requires both time and working space, both of which are in especially short supply during a structural fire.

In a conventional arrangement, a section of fire hose is straightened out toward the fire, doubled back, and then doubled back again to proceed toward the fire. In such an arrangement, a double loop of fire hose is spread out without sharp kinks. However, the double loop requires a long section of working space. In a structural fire where working space is limited, such an arrangement is unwieldy and sometime impossible to use.

When fighting a fire in a stairwell, firefighters conventionally extend a section of fire hose down the stairs in a single loop. They then pull the hose up from the stairs from one end of the hose section as they advance toward the fire. Such a technique requires a long section of heavy, water-filled hose to be pulled up and out from the stairs.

In another conventional technique, firefighters extend a dry section of fire hose up a flight of stairs in a single loop. They then pull the hose down from the stairs from one end of the hose section while advancing toward the fire. Such a technique can be dangerous because it requires a firefighter to climb the stairs and be above the fire while laying out the hose in this manner.

When the firefighters have finished using the fire hose, they must roll it up or bundle it for storage. The format in which the hose is stored depends on the manner in which it is intended to next be deployed. A compact hose roll, commonly known as a "doughnut roll," may be used to store the hose in a compact format, although the hose must be methodically spread out before water pressure is applied to it.

The expanded hose coil is used in wildland firefighting. In this arrangement, the hose is coiled up with a radius that is large enough to prevent kinking of the hose. The expanded hose coil may then be folded up into a compact package for transportation to another wildland fire.

Although devices having extension arms for rolling up fire hose into an expanded hose coil are known, such devices are unsatisfactory for use generally, and specifically in fighting structural fires. Fire hose used in fighting structural fires is generally of a larger diameter than hose used in wildland firefighting. Expanded hose coils wound with known devices have inadequate radius to be suitable for such hose. Inadequate safety of such devices remains a concern because the extension arms have the potential to cause injury if the hose unrolls suddenly. In addition, such devices lack the compactness and versatility required of firefighting tools.

SUMMARY OF THE INVENTION

A hose roller according to various aspects of the present invention is used to roll up collapsed hose into an expanded hose coil. Such a hose roller includes a crank and a mounting plate. In a variation, the crank is removable, having a handle and a forked shaft, which is inserted into the mounting plate. In such a variation, the plate rotatably mounts on one side to a fixed support, and receives the forked shaft on the opposite side.

A dual-mode hose roller according to various aspects of the present invention may be used to roll up collapsed hose into either a compact hose roll or an expanded hose coil. Such a hose roller includes mechanical connection points for extension arms, which allow the hose roller to be adapted for rolling up collapsed hose into an expanded coil. Such a hose roller also includes mechanical connection points for a removable crank, which allow the hose roller to be adapted for rolling up and convenient removal of a compact hose roll.

The crank and mounting plate are arranged to facilitate transmission of torque from the crank to the desired type of hose winding. When a compact hose roll is desired, torque is transmitted directly to the hose through a mechanical connection between the forked shaft and an end of a section of collapsed hose. When an expanded hose coil is desired, torque is transmitted to the hose through the mounting plate and the plurality of extension arms.

In a variation, the mounting plate is rotatably mounted on a fixed support through a bearing and a ratchet mechanism. By limiting the rotation of the mounting plate to one direction, the ratchet mechanism prevents the hose roller from unwinding in response to tension from the hose being rolled up. Thus, the potential for injury from the extension arms is reduced.

In another variation, the extension arms are sized so that the hose roller forms an expanded hose coil having a suitable diameter for structural fire hose. In a further variation, the minimum separation of opposing points of the coil is approximately 48 inches. This separation ensures that pressure may be applied, without kinking, to an expanded hose coil of 1½ inch diameter heavy duty fire hose. In a still further variation, the minimum separation of the coil is approximately 58 inches. This separation ensures that pressure may be applied, without kinking, to an expanded hose coil of 1¾ inch structural firefighting hose. By permitting such large diameter hose to be used, such a variation permits an expanded hose coil to be used in efficient structural firefighting.

In accordance with various methods of the present invention, preparation is made for fighting a structural fire by arranging a section of collapsed hose into a hose bundle. A section of hose is rolled up into an expanded hose coil and arranged into a number of hose loops to form a hose bundle. In one such method, the hose bundle is stored in a hose compartment of a fire engine, from which it may be removed for deployment. In another such method, the hose bundle is stored in a box. When water pressure is applied to the hose bundle, it falls out of such a box to form an expanded hose coil.

An automatically deployable hose pack according to various aspects of the present invention allows fire hose to respond to pressurization by falling out of a box onto a flat surface, then filling with water to form an expanded hose coil. Such a hose pack includes a box and a section of fire hose enclosed within the box. The hose is arranged as an expanded hose coil that has been folded up into a number of parallel hose loops. By folding the expanded hose coil into a limited number of parallel loops, each loop is made sufficiently long to accept pressurization without kinking.

BRIEF DESCRIPTION OF THE DRAWING

Embodiments of the present invention will now be described with reference to the drawing, wherein like designations denote like elements, and:

FIGS. 8, 9, and 10 are front views of the mounting plate of FIG. 6;

DESCRIPTION OF PREFERRED EXEMPLARY EMBODIMENTS

Figure 1:
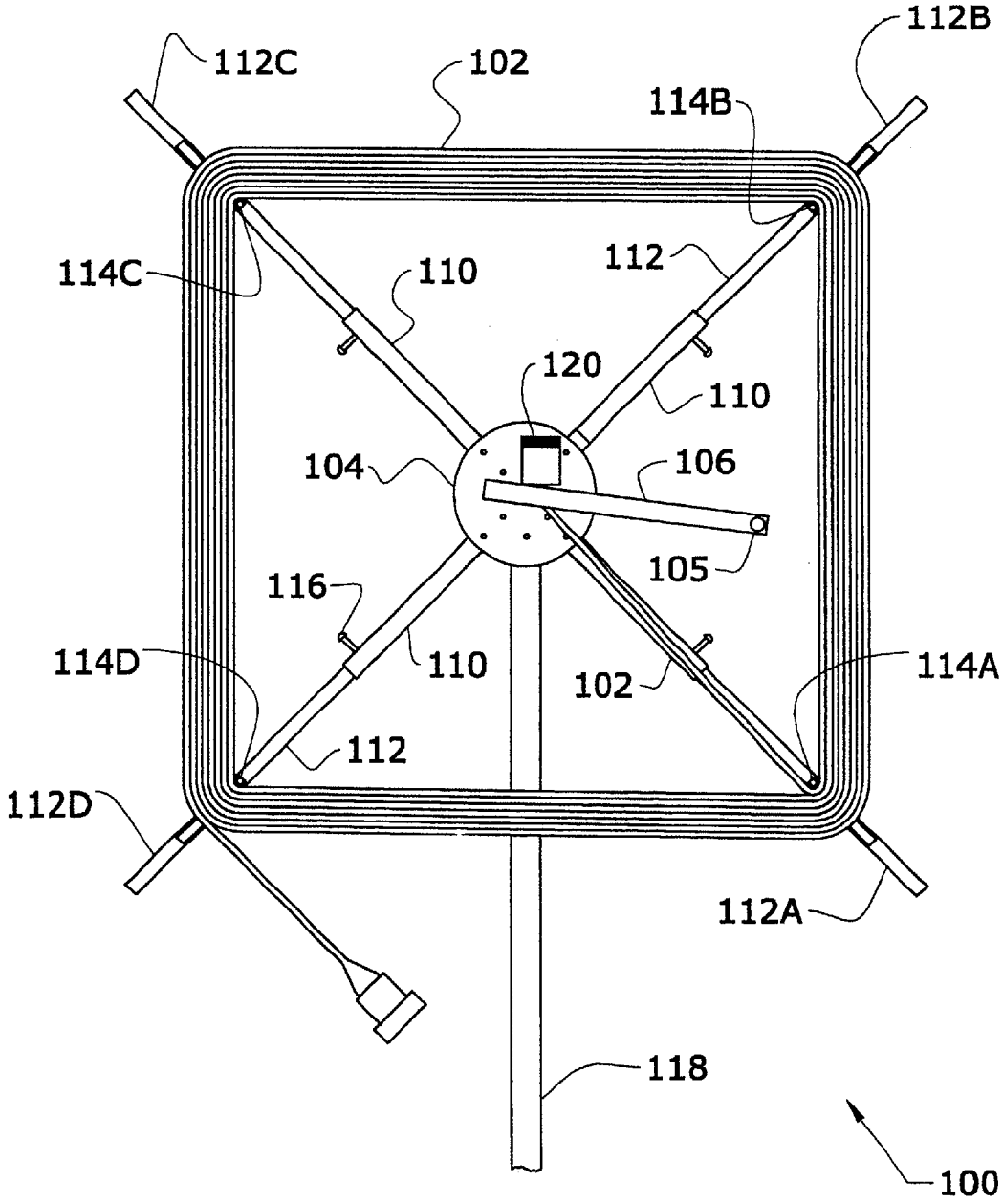
FIG. 1 is a front view of a hose roller arranged with extension arms for rolling up hose into an expanded hose coil according to various aspects of the present invention.
Figure 2:
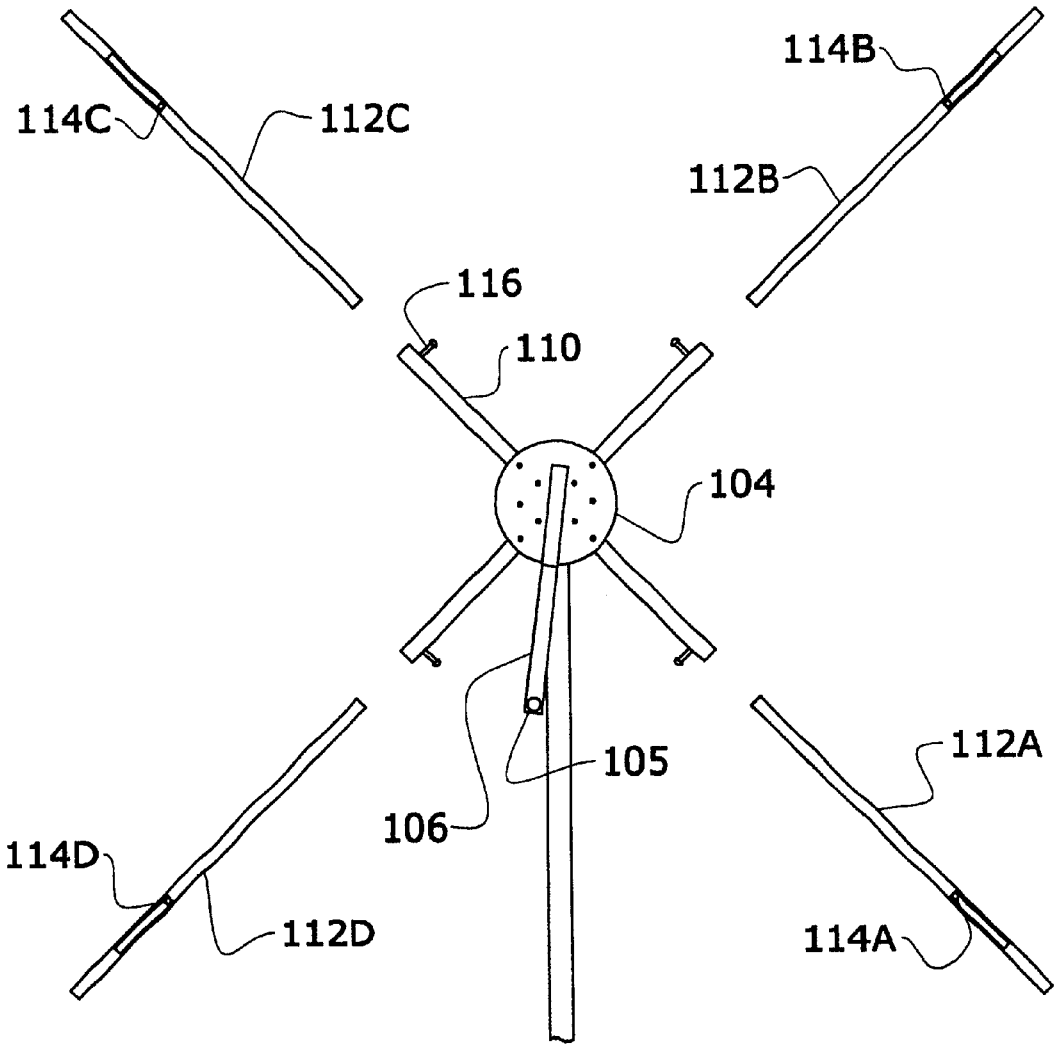
FIG. 2 is an exploded front view of the hose roller of FIG. 1.

As illustrated in FIG. 1 through FIG. 4, a hose roller 100 in accordance with various aspects of the present invention includes: a mounting plate 104; a crank 106; a plurality (e.g., 4) of radial tubes 110; a plurality of extension arms 112 (one arm denoted as 112A through 112D for each radial tube 110), each including a hose retaining peg 114 (one peg denoted as 114A–114D for each arm 112A–112D); an axial mounting shaft 122; and a fixed support 118, which includes a bearing 124. In general, mounting plate 104 is rotatably mounted on support 118 and shaft 122 is received in bearing 124. In a variation, a ratchet mechanism cooperates with bearing 124 to limit the rotation of mounting plate 104 in one direction while allowing unrestricted rotation in the opposite direction. Radial tubes 110 extend outwardly from mounting plate 104, preferably in the same, or in a parallel plane. Extension arms 112 are received in radial tubes 110, preferably fixed in place by a suitable fastening mechanism 116.

Crank 106 may be any suitable structure for transmitting torque to either a compact hose roll (directly) or an expanded hose coil (through mounting plate 104 and extension arms 112), depending on the configuration desired. In a variation, crank 106 is manufactured from solid material (e.g. a durable metal such as cold-rolled steel) and includes respective connecting rods 108 and 109 (best seen in FIGS. 3 and 4) and is removably attached to mounting plate 104 on the opposite side of the plate from support 118. Connecting rods 108 and 109 are received in corresponding apertures of plate 104. If desired, mounting plate 104 may include suitable structure (e.g. a pin or other fastener) for securing rods 108 and 109 to mounting plate 104 until crank 106 is to be released and removed.

Figure 3:
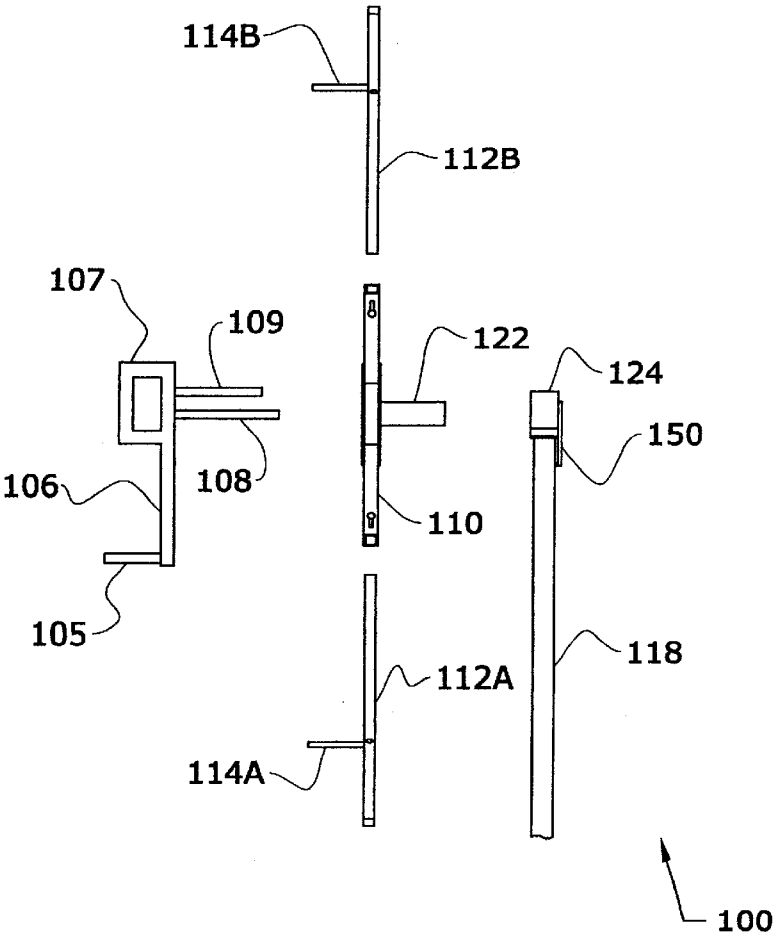
FIG. 3 is an exploded side view of the hose roller of FIG. 1.
Figure 5B:
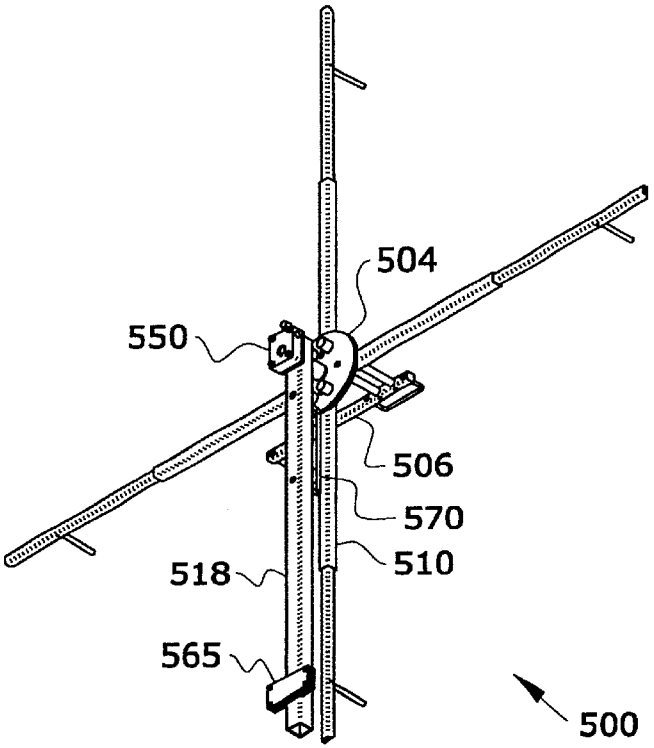
FIGS. 5A and 5B are perspective views of a hose roller according to various aspects of the present invention, including a ratchet mechanism.
Figure 5A:
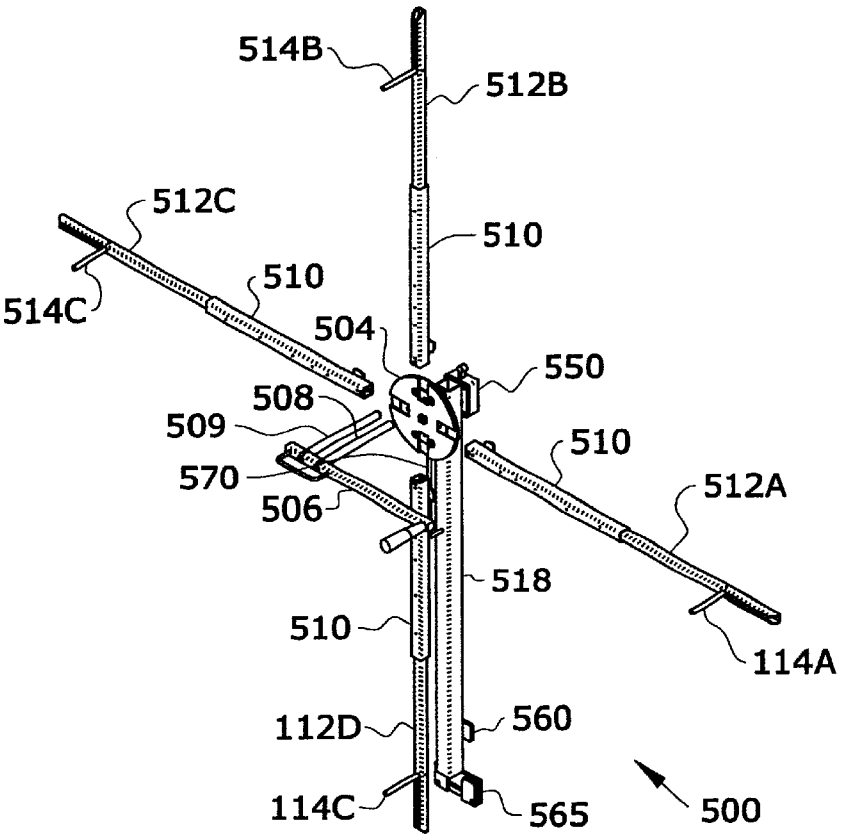

Crank 106 preferably includes a first handle 105 and a second handle 107, best seen in FIG. 3. Handle 105 provides a grip for transmission of torque to crank 106. Handle 107 provides a grip for additional support when a compact hose roll is removed (with crank 106) from mounting plate 104. Consequently, an operator may support a compact hose roll using handle 107. Handle 105 is preferably rotatable with respect to the body of crank 106 to make crank 106 easier to turn.

In another variation, rods 108 and 109 are selected from a kit of several available cranks or rods, each being long enough to accommodate the desired width of hose 102 as it lies flat between crank 106 and mounting plate 104. When sized in this manner, rods 108 and 109 may snugly receive hose 102 and thus be prevented from being pushed so far into mounting plate 104 as to cause interference with fixed support 118 as mounting plate 104 rotates. In addition, rods 108 and 109 may receive flat hose of large diameter hose, multiple lengths of hose to be rolled at once, or hose rolled in compact hose rolls of double width. In a variation, mounting plate 104 includes suitable structure for preventing rods 108 and 109 from being pushed too far into plate 104. Consequently, interference with fixed support 118 is avoided.

Preferably, a portion of hose 102 in the vicinity of a hose coupling 120 is secured to hose roller 100 by removing crank 106 from mounting plate 104, capturing hose 102 between shafts 108 and 109, and reinserting rods 108 and 109 in plate 104. Rods 108 and 109 preferably have differing lengths. Such an arrangement allows longer rod 108 to be inserted into its corresponding aperture first, thereby providing stability for easier insertion of rod 109 into its corresponding aperture. As rods 108 and 109 are reinserted (illustrated in FIG. 4), coupling or nozzle 120 of hose 102 is secured in place so that the remainder of hose 102 may be rolled up.

Figure 17:
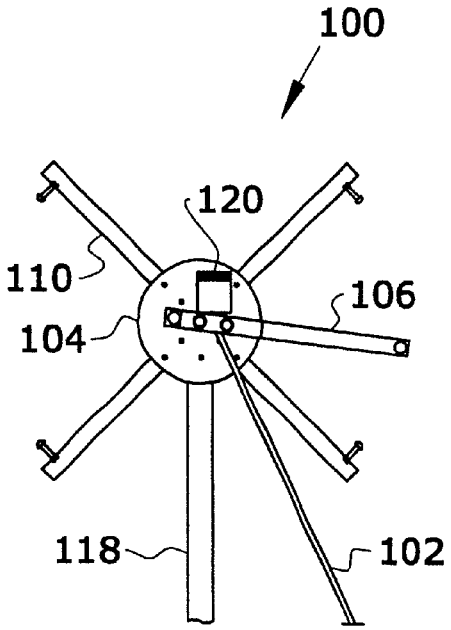
FIG. 17 is a front view of a hose roller arranged without extension arms for rolling up hose into a compact hose roll according to various aspects of the present invention.

In operation, hose roller 100 may be used to wind hose 102 into either a compact hose roll or an expanded hose coil, as desired. When a compact hose roll is desired, extension arms 112 are detached from hose roller 100. FIG. 17 illustrates roller 100 with radial tubes 110 attached to mounting plate 104, and with extension arms 112 detached. Radial tubes 110 support hose 102 as it is rolled up, and are preferably long enough to provide support for the entire radius of a compact hose roll.

As is discussed below, radial tubes 110 are preferably detached along with extension arms 112 when alternate structure is available for supporting hose 102 as it is rolled up into a compact hose roll. Such alternate structure may be better understood with reference to FIG. 18. Hose roller 500 is used without radial tubes 510 to roll up hose into a compact hose roll 1810. When so configured, hose roller 500 is compact and may be stored in a small storage area of a fire engine.

Figure 18:
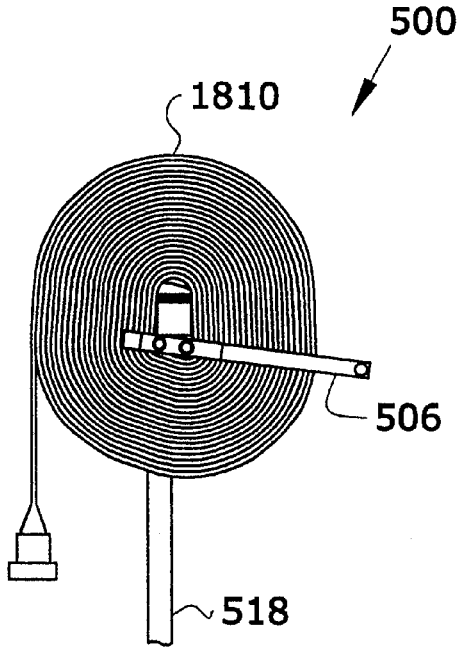
FIG. 18 is a view of a hose roller, arranged without radial tubes or extension arms, and a section of collapsed hose that has been rolled up into a compact hose roll according to various aspects of the present invention.

Hose 102 is then rolled up around itself, as illustrated in FIG. 18, starting at the portion of hose nearest coupling 120, to form a compact hose roll 1810. Crank 106 transmits torque directly to the compact hose roll through a mechanical connection between rods 108 and 109 and coupling 120.

Figure 19:
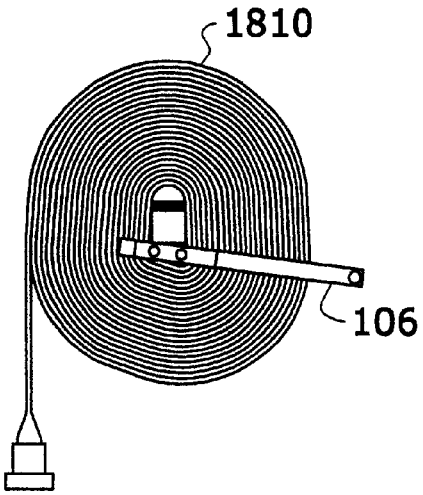
FIG. 19 is a front view of a compact hose roll after being removed from the hose roller of FIG. 18.
Figure 20:
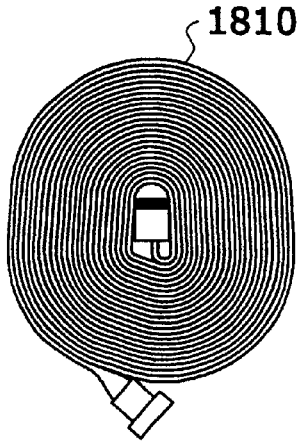
FIG. 20 is a front view of the compact hose roll of FIG. 19 after a handle of the hose roller of FIG. 18 has been removed from the hose roll.

Once hose 102 has been completely rolled up into compact hose roll 1810, crank 106 is pulled out of mounting plate 104. Hose roll 1810 is removed from hose roller 100 along with crank 106, as illustrated in FIG. 19. Crank 106 is then removed from hose roll 1810, as illustrated in FIG. 20.

When used for rolling hose 102 into an expanded hose coil, hose roller 100 includes suitable extension arms, which may be any structure for receiving hose in an expanded hose coil as it is rolled up. An expanded hose coil is any coil of hose having sufficient diameter to prevent the hose from kinking when water pressure is applied. Extension arms separate portions of the hose from each other to ensure that the resulting hose coil has sufficient diameter.

Figure 4:
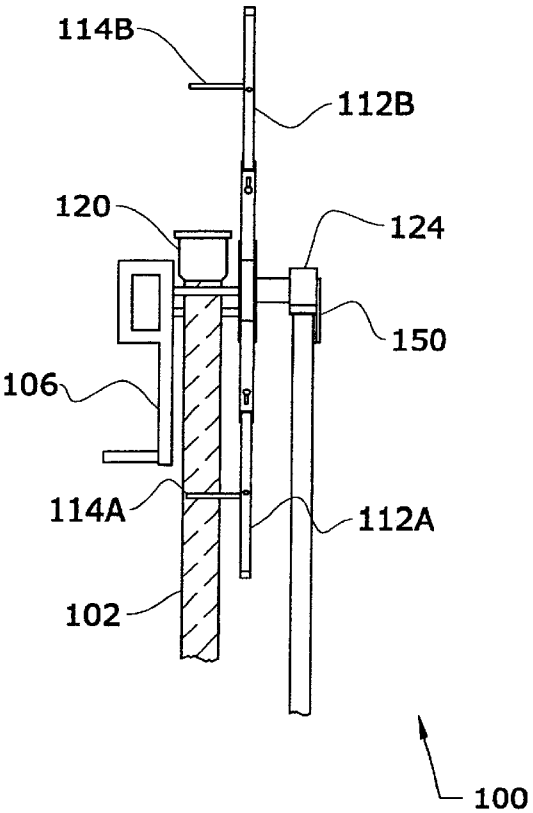
FIG. 4 is a side view illustrating the securing of hose to the hose roller of FIG. 1.

When an expanded hose coil is desired, coupling 120 is secured to hose roller 100, for example in the manner illustrated in FIG. 4. Mounting plate 104 and extension arms 112 are then rotated in response to torque from crank 106 so that hose retaining peg 114A comes into contact with hose 102. Extension arm 112A then lifts hose 102 (via peg 114A) and bends the hose, drawing it toward roller 100. Extension arms 112 rotate further until another peg 114B comes into contact with hose 102. Extension arm 112B then lifts hose 102 (via peg 114B) and bends the hose further, drawing it further in toward roller 100. Mounting plate 104 is rotated further, rotating extension arms 112C and 112D to bring pegs 114C and 114D into contact with hose 102. Extension arms 112 are rotated until an entire section of hose 102 has been received on pegs 114 to be rolled up into an expanded hose coil.

A mounting plate of the present invention (e.g., mounting plate 104) may be any suitable structure rotatably mounted on a fixed support for transmitting torque from a crank to extension arms. Mounting plate 104 includes any suitable structure for providing releasable mechanical connection to crank 106. Mounting plate 104 of FIGS. 1 and 2, for example, is a circular piece of rigid material (e.g. a metal such as carbon steel) having a plurality of holes for receiving rods 108 and 109 of crank 106 and a plurality of fasteners. Such fasteners may include any suitable bolts, nuts, screws, or other mechanical connection devices for releasably connecting radial tubes 110 to plate 104. Preferably, such fasteners are configured to facilitate a quick release of tubes 110 from plate 104.

In a variation, radial tubes 110 are fixedly mounted to mounting plate 104 by welding, adhesion, or unitary construction of plate 104 and tubes 110 from a single piece of material. In such a variation, no fasteners or corresponding holes are required to secure tubes 110 to plate 104.

In another variation, radial tubes 110 are releasably mounted to a mounting plate using a tab-and-slot interface. Hose roller 500, which may be better understood with respect to FIGS. 5,6, and 8–10, includes a mounting plate 504 suitable for such an interface.

Hose roller 500 includes: mounting plate 504; a crank 506 including respective connecting rods 508 and 509; a plurality (e.g., 4) of radial tubes 510; a plurality of extension arms 512 (one arm denoted as 512A through 512D for each radial tube 510), each including a hose retaining peg 514 (one peg denoted as 514A–514D for each arm 512A–512D); and a fixed support 518 including a riser handle 570 and a mounting tab 560. Hose roller 500 also includes bearing 530 and 535 and an axial mounting shaft 640, best seen in FIG. 6. Variations between hose roller 100 and hose roller 500 include: more equal lengths of rods 508 and 509; the tab-and-slot interface between mounting plate 504 and radial tubes 510; the arrangement of ratchet mechanism 550 on fixed support 518; the arrangement of hose retaining pegs 514 in extension arms 512; and support of hose by riser handle 570 rather than by radial tubes 110 as it is rolled up into a compact hose roll.

Figure 6:
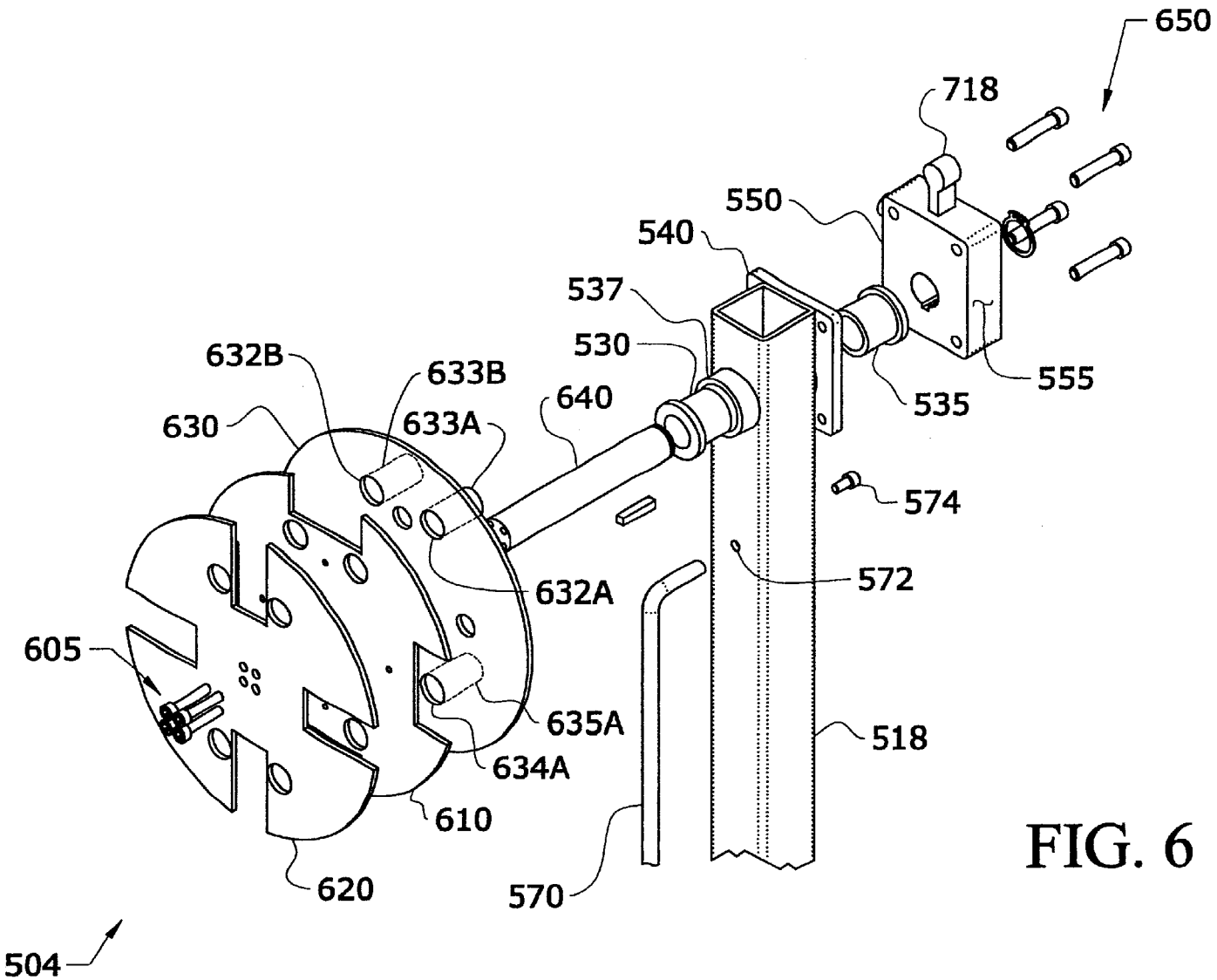
FIG. 6 is an exploded perspective view illustrating a mounting plate and fixed support of the hose roller of FIG. 5.

Mounting plate 504 is comprised of three parallel plates 610, 620, and 630. Plates 610–630 are stacked together to form four slots, which are preferably spaced equidistant around the circumference of mounting plate 504. Four such slots are preferably provided, as illustrated in FIG. 6. Alternatively, three or five slots may be provided to receive three or five radial tubes and respective extension arms.

A mounting plate of the present invention includes any suitable structure for receiving rods of a crank in a releasable fashion. For example, a mounting plate may include cups for receiving the ends of such rods, the openings of which may be formed from holes in the plate. Such cups may be attached to the mounting plate. Alternatively, the cups and plate may be formed from the same piece of material. Plates 610–630 include two pairs of such holes. Either pair of holes may be used to receive rods 508 and 509 of removable crank 506. When plates 610–630 are stacked together, one set of holes is formed from pair 612 (including holes 612A and 612B), lined up with pair 622 (including holes 622A and 622B) and with pair 632 (including holes 632A and 632B). Similarly, another pair of holes is formed from pairs 614, 624, and 634.

Plate 630 further includes pairs of cups 633 (including cups 633A and 633B) and cups 635 (including cups 635A and 635B). Holes 632 form openings of cups 633 while holes 634 form openings of cups 635. When crank 506 is inserted in mounting plate 504, the ends of rods 508 and 509 pass through holes in place 610–630, as discussed above, and are received in pair of cups 633 or cups 635. Cups 633A, 633B, and 635A are drawn with dashed lines in FIG. 6 to illustrate their arrangement on opposite side of plate 630 from plates 610 and 620. Cup 635B is obscured in FIG. 6 by plate 610.

Plates 610–630 may be secured together to an axial mounting shaft 640, for example by a set of screws 605 (preferably having Allen heads). Screws 605 are preferably made of material having a high tensile strength. Plates 610–630 include respective sets of holes 618, 628, and 638 for receiving screws 605. Plates 610 and 630 also include small holes 616A–616D and large holes 636A–636D, respectively, that line up with respective slots of plate 620. These holes allow the operator of hose roller 500 to depress a plunger pin 1140 with a finger for release of radial tube 510 from mounting plate 504. Plunger pin 1140 is further described below with reference to FIG. 11.

A fixed support of the present invention includes any suitable structure for supporting a mounting plate in a manner that allows the mounting plate to rotate in response to torque from a crank. For example, fixed support 518 is a hollow tube (preferably constructed of a lightweight metal) having dimensions of 1½ inch by 1½ inch square. Support 518 may be mounted to any suitable external support structure (not shown) by a tab-and-slot interface between tab 560 and mounting bracket 565 (shown in FIGS. 5A and 5B). A suitable tab and-slot interface is one similar to that described above with respect to mounting plate 504 and radial tubes 510. For example, mounting bracket 565 may be attached to a vertical surface such as the tail-board or bumper of a fire engine. In a variation, square tubing of support 518 slides into a square receiving hole and may be fixed in place either vertically or horizontally, as desired. When fixed in place vertically, roller 500 may be oriented in a desired one of a plurality of directions, spaced 90° apart to roll up hose from various directions. Thus, a square receiving hole arrangement allows flexibility in mounting of hose roller 500. Consequently, roller 500 may be quickly placed in service at a nearby support after being removed from one of a number of possible compartments on a fire engine. Fixed support 518 may also be received, for example, in a hose drying rack or on a wheeled portable stand, or a conventional 2-inch trailer hitch receiving hole.

Preferably, radial tubes are removed from the mounting plate when a compact hose roll is desired, without being separated from their respective extension arms. A compact hose roll then may be formed with a compact hose roller that omits radial tubes aid extension arms.

In such a variation, riser handle 570 may be provided on fixed support 118 to provide a support by which the hose is guided and self-aligned for the entire radius of a compact hose roll of hose 102 as it is rolled up. Handle 570 is mounted on fixed support 518 (via hole 572 and screw 574) in such a manner that it does not prevent radial tubes 510 and extension arms 512 from being used when an expanded hose coil is desired. Handle 570 may also serve as a carrying handle for hose roller 500. Alternative structure for supporting a compact hose roll may also be used in place of radial tubes 510 or riser handle 570.

A radial tube according to various aspects of the present invention includes any structure for mounting on the mounting plate and receiving a portion of an extension arm. A preferred radial tube is constructed from lightweight metal tubing having outside dimensions of 1 inch by 1 inch square. A preferred extension arm is constructed from lightweight metal tubing having outside dimensions of ¾ inch by ¾ inch square. Preferably, a radial tube may receive an adjustable portion of the extension arms to vary the total length of the connected radial tube and extension arm. In a variation, a mounting plate and extension arms according to various aspects of the present invention are fixedly mounted together, and radial tubes are omitted.

Radial tube 510, which may be better understood with reference to FIG. 11, includes a tab 1110 for insertion into a corresponding slot of plate 504. Tab 1110 is located near a first end 1150 of radial tube 510 at which tube 510 is to be secured to mounting plate 504. Preferably, tab 1110 includes angled leading edges 1112 to guide tab 1110 into the corresponding slot of mounting plate 504. After insertion, tube 510 may be further secured in plate 504 by plunger pin 1140.

Figures 11A, 11B:
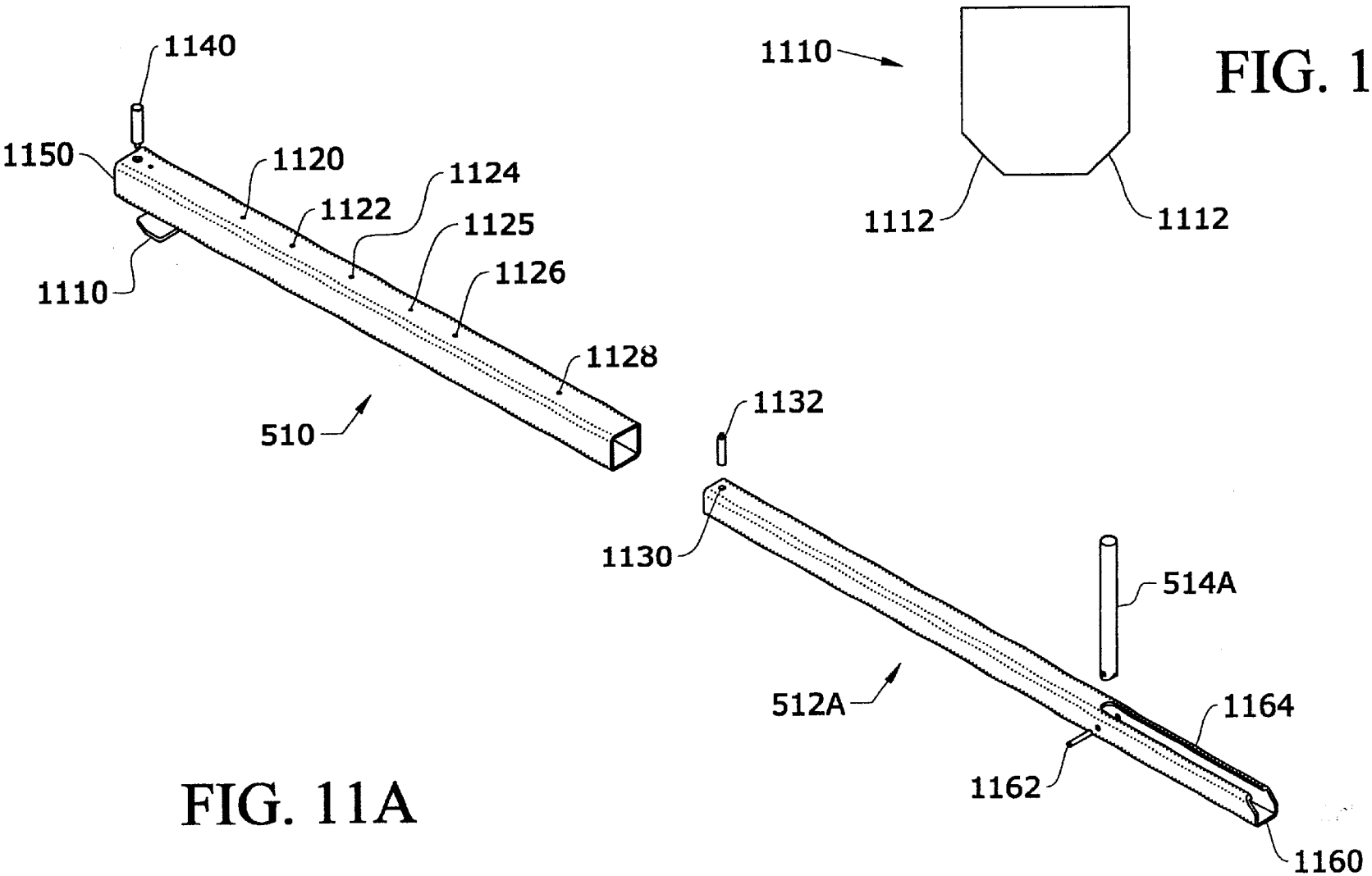
FIG. 11A is a perspective view of an extension arm according to various aspects of the present invention.
FIG. 11B illustrates a tab of the extension arm of FIG. 11A.

Extension arm 512A is received in radial tube 510, secured by plunger pin 1132. Pin 1132 passes through hole 1130 in extension arm 512A and, when not depressed, a selected hole 1120, 1122, 1124, 1125, 1126, 1128 in tube 510. Holes 1120–1128 are depicted in FIG. 11A, without reference necessarily to any particular scale. Selected hole 1120–1128 is chosen in accordance with a desired distance between peg 514A and end 1150 of radial tube 510. End 1150 is secured to mounting plate 504, and is close to the center of mounting plate 504 and the axis of rotation of extension arm 512A. A desired distance between peg 514A and end 1150 is determined by the separation between peg 514 and the axis of rotation.

Preferably, a predetermined minimum separation exists between a hose retaining peg and the axis of rotation of the hose roller on which it is mounted. This separation is dependent on the type of hose to be rolled up. Accordingly, holes 1120–1128 may be spaced from end 1150 to provide the appropriate minimum separation for a number of types of hose. Table I below shows preferred minimum separations for various types of fire hose. Other minimum separations may be determined based upon evaluations of other types of hose. For example, hose not used in firefighting may have entirely different characteristics and require larger or smaller minimum separations to prevent kinking when pressurization is applied.

TABLE I

| Hose Type | Hose Diameter (inches) | Separation between peg and axis of rotation (inches) | Separation between opposing pegs in 4-peg roller (inches) |
|---|---|---|---|
| Single/ Double jacket | 1.75 | 29 | 58 |
| Synthetic "hose cabinet" | 1.5 | 25.5 | 51 |
| Double jacket (heavy duty) | 1.5 | 24 | 48 |
| Single jacket | 1.5 | 22 | 44 |
| Single jacket | 1.0 | 20 | 40 |
| Single jacket | 0.75 | 17 | 34 |

Hose retaining peg 514A is pivotably secured to extension arm 512A near a second end 1160 by pin 1162. A portion of arm 512A extends beyond the location of peg 514A to provide support for coils of hose that rest on peg 514A as the hose is rolled up onto hose roller 500. A slot 1164 is cut into this portion of arm 512 to allow peg 514A to swing toward end 1160 and into arm 512A for storage. When extension arm 512A is fully retracted inside radial tube 510A, peg 514 fits in slot 1164 and inside tube 510A.

While hose retaining pegs 114 and 514 are described above as being straight segments of rod (preferably constructed of a strong, lightweight metal), other suitable types of support may also be used. For example, the end of such a peg may be bent upwards to help prevent hose from falling off the extension arms to which they are attached. When the hose is to be removed from the extension arms, such a peg may be twisted to move the bent portion away from the coiled hose.

Hose roller 100 of FIGS. 1–4 includes an axial mounting shaft 122 that is inserted into bearing 124. Similarly, hose roller 500 of FIG. 5 includes an axial mounting shaft 640 that is inserted into sleeve bearing 530 and bearing housing 537. Housing 537 extends through support 518 and mounting plate 540. Shaft 640 and bearing 530 of roller 500 are smaller, however, than shaft 122 and bearing 124 of roller 100.

Hose roller 100 preferably includes a ratchet mechanism (not evident in FIGS. 1–4) that cooperates with bearing 124 to limit rotation of shaft 122 in one direction. Similarly, hose roller 500 preferably includes a ratchet mechanism 550 that cooperates with bearing 530 to limit rotation of shaft 640 in one direction. As is illustrated in FIG. 6, ratchet mechanism 550 includes a handle 718 and is mounted on fixed support 518 by a set of screws 650, preferably having Allen heads. A second sleeve bearing 535 allows shaft 640 to extend through a mounting plate 540 into ratchet mechanism 550.

Ratchet mechanism 550 may be any structure for limiting rotation of shaft 640 in one direction, when desired. For example, a commercially available ratchet clutch marketed as part number 71901 by the Lowell Corporation (Worcester, Mass.) may be used. A detailed description of such a ratchet clutch may be found in the Lowell Corporation's "Ratchet Technology" catalog, PLC96, pages 21–23, incorporated herein by reference. When such a ratchet clutch is used for ratchet mechanism 550, handle 718 may be pushed to one side or the other to enable rotation in either of two directions while limiting rotation in the opposite direction. In addition, mechanism 550 may be disengaged (by pulling handle 718 upwards) to enable rotation in both directions.

Figure 7B:
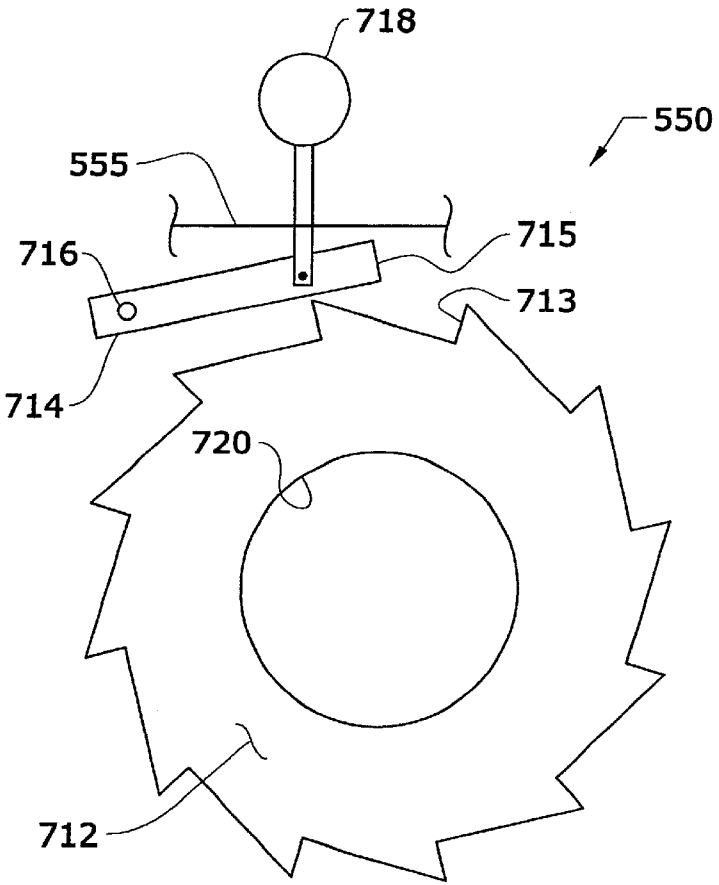
FIGS. 7A and 7B provide a simplified example of the operation of a suitable ratchet mechanism for a hose roller according to various aspects of the present invention.
Figure 7A:
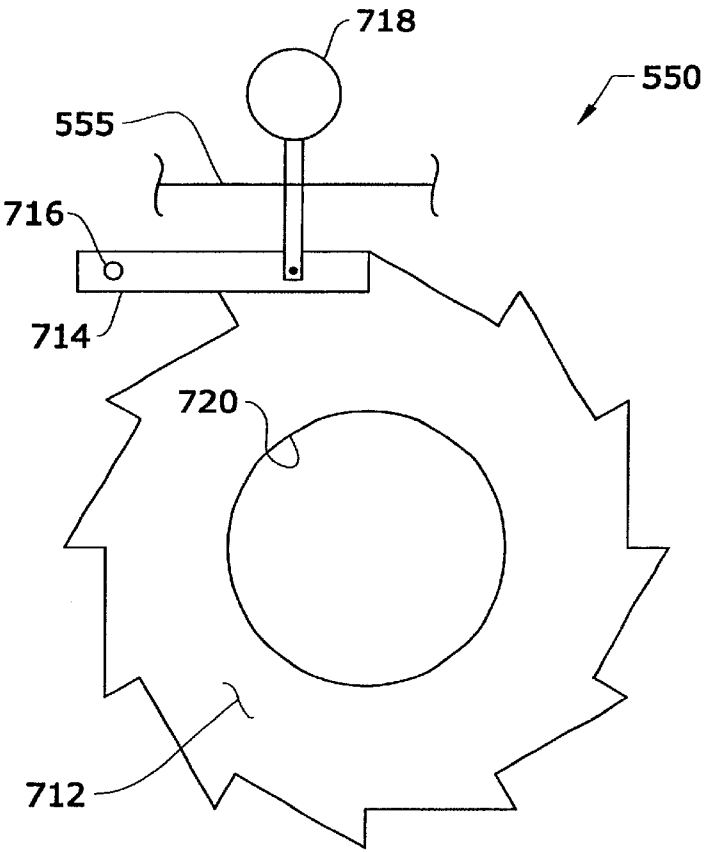

The operation of ratchet mechanism 550 may be better understood by a simplified example provided with reference to FIGS. 7A and 7B. In a housing 555, structure for ratchet mechanism 550 includes: a rotatable ratchet wheel 712 having an aperture 720 for receiving shaft 640; a follower 714 mounted on a pivot point 716; and a handle 718 for manually raising follower 714. Ratchet wheel 712 includes teeth around its circumference, each having a gradually sloping face and end abruptly sloping face. Aperture 720 and shaft 640 include suitable keying, friction, or other mechanical connection for transmitting torque from shaft 640 to ratchet wheel 712. Handle 718 extends outside housing 555.

In operation, ratchet wheel 712 rotates in a clockwise direction as torque from crank 506 turns shaft 640. As ratchet wheel 712 rotates, gradually sloping faces of its teeth push follower 714 up and out of the way. If counter-clockwise torque is applied to ratchet wheel 712, however, an abruptly sloping face 713 of one of its teeth comes into contact with a flat side 715 of follower 714. Abruptly sloping face 713 fails to raise follower 714, and ratchet wheel 712 is prevented from rotating further in a counter-clockwise direction. Follower 714 may be pulled upwards by handle 718 to allow ratchet wheel 712 to spin freely in either direction.

In selecting any type of material to be used for construction of a hose roller according to various aspects of the present invention, the cost and strength of the various available materials may be considered. While it is preferable that such a hose roller be as light and strong as possible, inexpensive materials that do not meet such an ideal goal may also be used, as desired. For example, an inexpensive but strong plastic material may be used, especially when smaller diameter hose is to be rolled up. When light weight and strength are both desired, a non-metallic composite material may also be used.

Size may also be a consideration for construction of a hose roller in accordance with the invention. Preferably, such a roller should fit into the compact spaces available for storage in a fire engine. In order for such a roller to fit into a desired variety of such spaces, its maximum length, width, and depth (when disassembled) may be advantageously limited to about 24 inches by about 7 inches, by about 5 inches, respectively.

According to various aspects of the present invention, a hose roller is particularly suited for creating a hose pack, which includes a box and a hose bundle. A hose bundle is arranged in a box as a plurality of hose loops of a folded-up expanded hose coil. Such hose loops are parallel to each other, and have a length approximately equal to the radius of the expanded hose coil. Such a length permits the hose loops to accept pressurization without kinking.

In accordance with the invention, the hose falls out of the box and forms an expanded hose coil when the hose is pressurized. A method of the present invention for creating such a hose bundle may be better understood with reference to FIGS. 12 through 16. In such a method, which may be performed by any suitable structure, an expanded hose coil is arranged into a hose bundle 1400 having substantially parallel loops. The hose bundle is then placed into a box 1500 to form an automatically deployable hose pack 1600.

Figure 12:
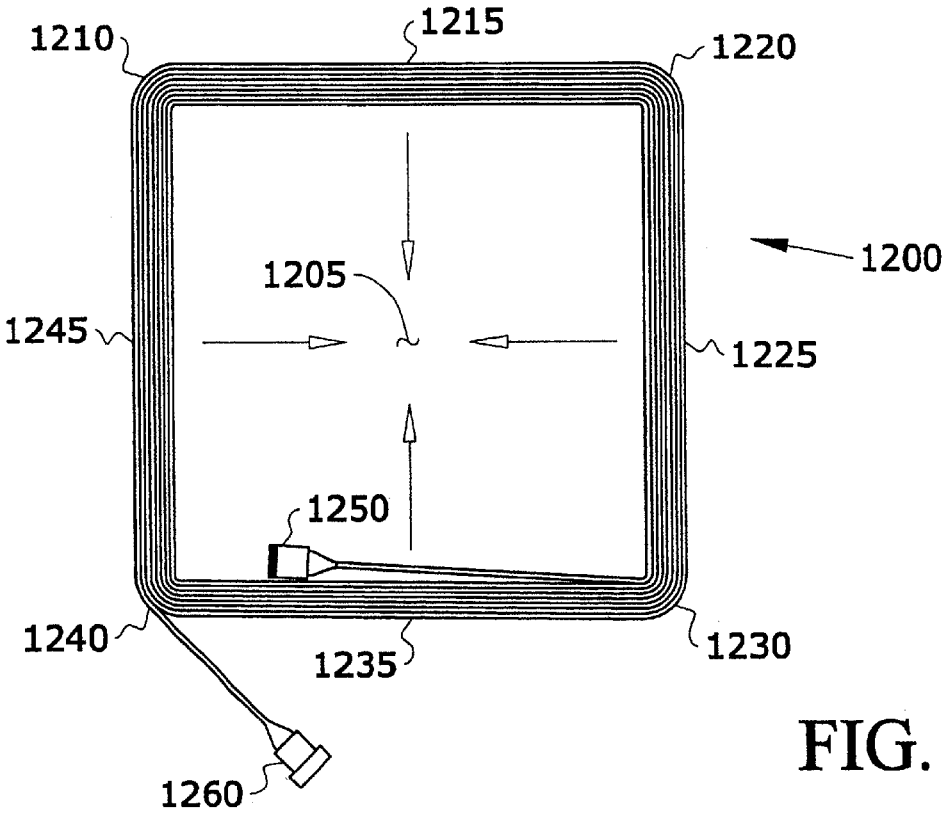
FIG. 12 illustrates a polygon of coiled hose having a plurality of corners according to a method of the present invention.

According to the method, an expanded hose coil (e.g. hose 102 of FIG. 1) is removed from a hose roller and placed flat on a surface (e.g. the floor of a fire station). The coil is arranged into a generally circular shape, such that all portions of the hose are approximately equidistant from a central point 1205 on the surface. As depicted in FIG. 12, a first group of opposing points on the expanded hose coil are separated from each other to form a polygon of coiled hose having a plurality of corners. For example, hose polygon 1200 has four corners 1210, 1120, 1230, and 1240. Corners 1210–1240 are substantially equidistant from central point 1205. A male coupling 1250 (preferably having a nozzle) is in the interior of hose polygon 200, while a female coupling 1260 is outside polygon 1200.

Figure 13:
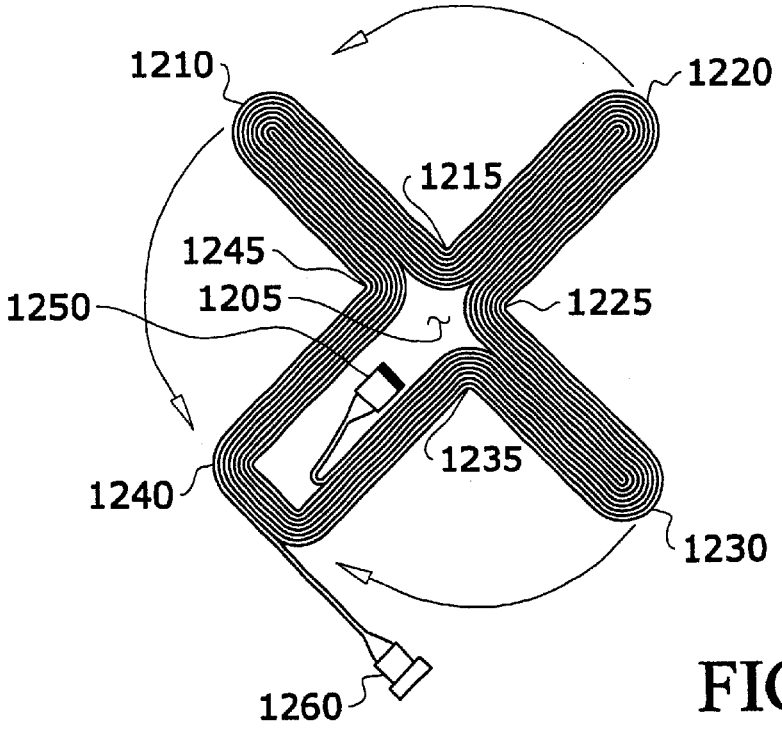
FIG. 13 illustrates the coiled hose of FIG. 12 after opposing points on the polygon have been moved toward a central point to form hose loops according to a method of the present invention.

A second group of opposing points 1215, 1225, 1235, and 1245 are brought toward central point 1205, as illustrated in FIG. 13, to form four hose loops. One hose loop, for example, extends between points 1215, 1220, and 1225. Another hose loop, for example, extends between points 1225, 1230, and 1235. Each of the four hose loops is bent to form a hose bundle 1400, best seen with reference to FIG. 14.

Female coupling 1260 is positioned at the end of hose bundle 1400 in a manner that allows coupling 1260 to be connected to a source of pressurized fluid (e.g., water). Male coupling 1250 is allowed to hang free of bundle 1400 by a short hose segment 1255. Hose bundle 1400 is then placed inside a box 1530 to form a hose pack 1500. Coupling 1250 and short segment 1255 are fed from the back side of hose bundle 1400 and pulled forward. This arrangement helps to ensure that coupling 1250 remains on top of hose bundle 1500 when it falls from box 1530 and pressurizes with fluid.

Figure 15:
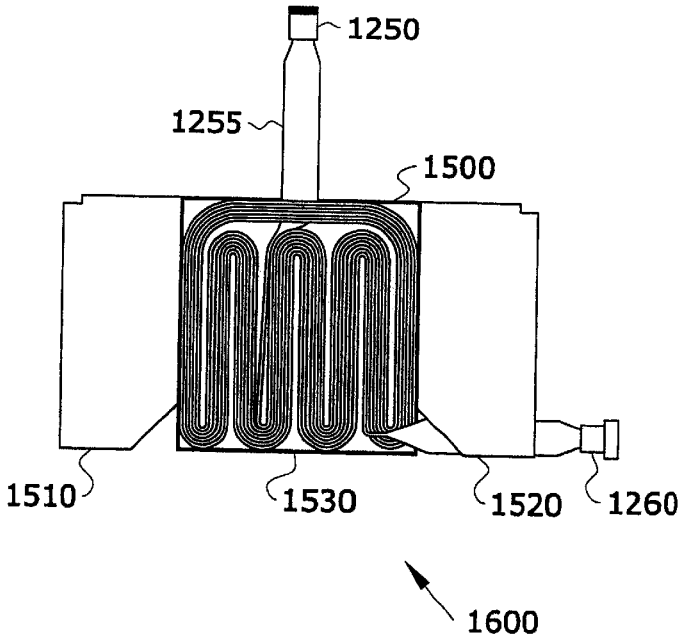
FIG. 15 illustrates the hose bundle of FIG. 14 stored in a box according to various aspects of the present invention.
Figure 16:
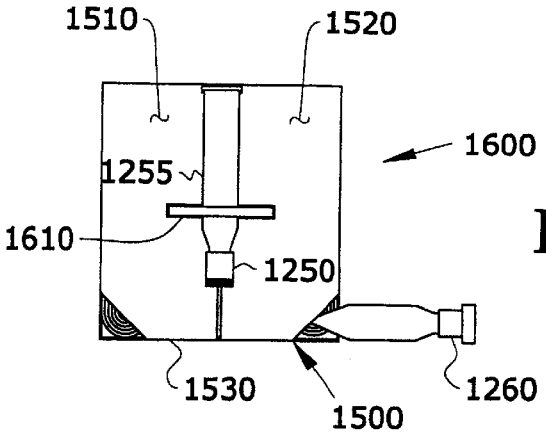
FIG. 16 is a front view of an automatically deployable hose pack according to various aspects of the present invention.

A hose pack according to various aspects of the present invention includes any structure containing a box and a section of fire hose enclosed within the box. More specifically, the hose is arranged as a hose bundle that falls out of the box to form an expanded hose coil when the hose is pressurized. In hose pack 1500 of FIG. 15, for example, box 1530 includes doors 1510 and 1520. Hose bundle 1400 is enclosed in box 1530 by doors 1510 and 1520, as illustrated in FIG. 16. Doors 1510 and 1520 may be releasably secured shut by a strap 1610 made of VELCRO material, or another fastener suitable for this function. VELCRO is a registered trademark of the Netherland Antilles Limited Liability Company.

Figure 14:
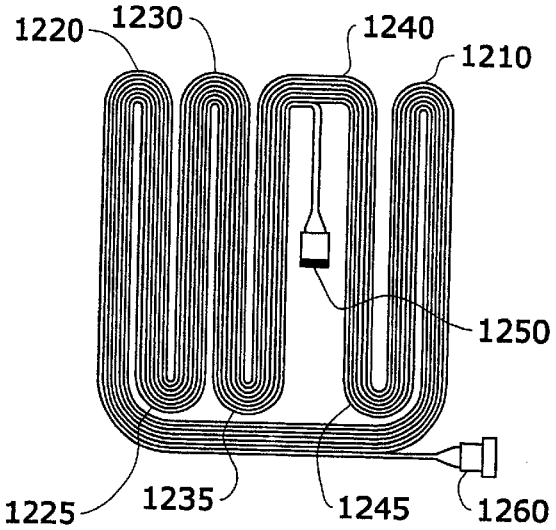
FIG. 14 illustrates the coiled hose of FIG. 13 after the hose loops have been arranged to be substantially parallel to form a hose bundle according to a method of the present invention.

Hose bundle 1400 expands when pressure is applied to it through coupling 1260. Consequently, releasable fastener 1610 separates and doors 1510 and 1520 are forced open. Hose bundle 1400 then further expands and falls out of box 1530 to form an expanded hose coil. When hose segment 1255 and coupling 1250 are arranged as illustrated in FIGS. 14–16, coupling 1250 tends to rest on top of the expanded hose coil where it can most easily be accessed and pulled away from the coil by a person fighting a fire. The simplicity of such an arrangement allows persons other than skilled firefighters to use coupling 1250 (when including a nozzle) to "hose down" and thus protect a point of exit.

Figure 21:
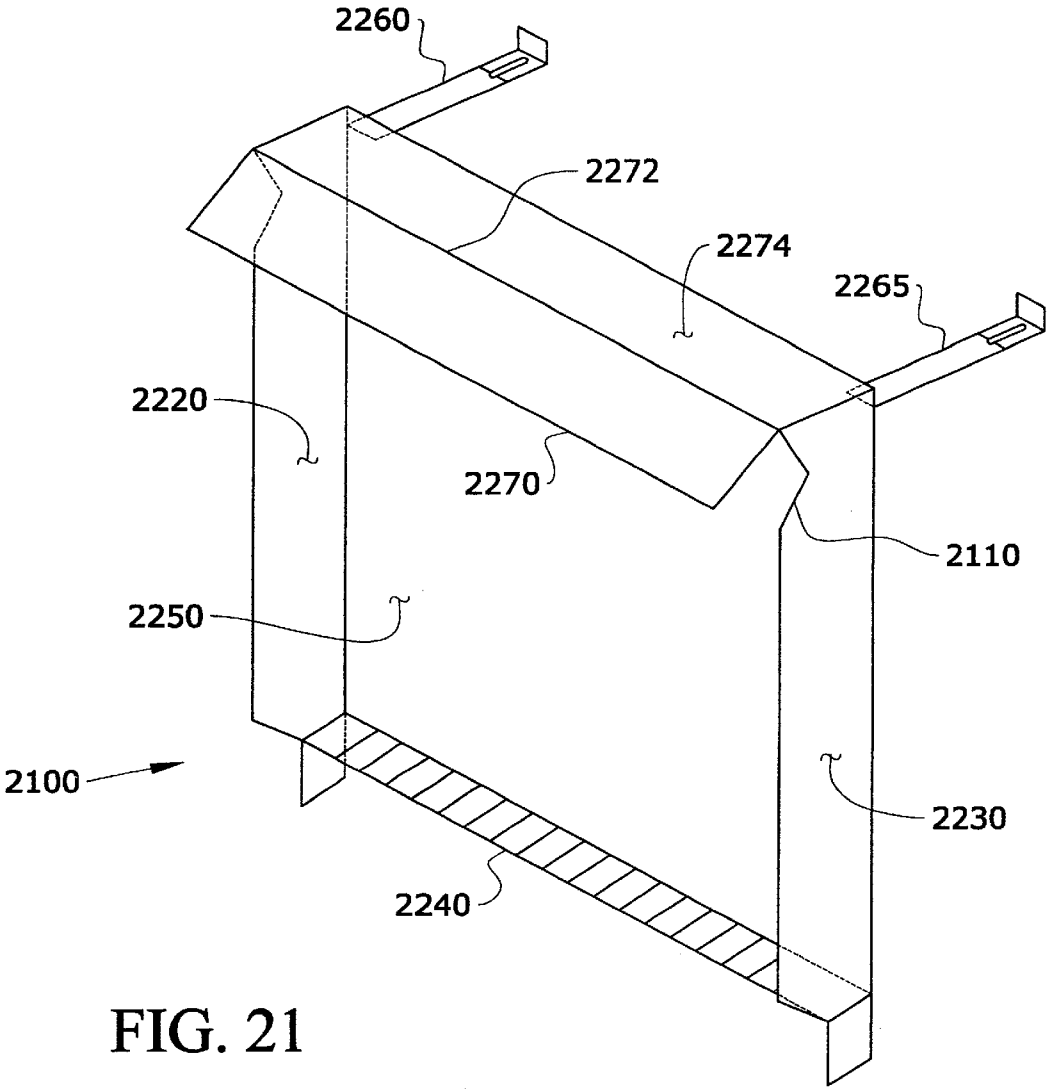
FIG. 21 is a perspective view of a box used in a hose pack according to various aspects of the present invention.

In a variation, a hinged upper lip is substituted for doors 1510 and 1520. Such a variation may be better understood with reference to FIGS. 21–23. Hose pack 2200 includes a box 2100 having: side walls 2220 and 2230; a bottom wall 2240; a back panel 2250; mounting supports 2260 and 2265; a top wall 2274; and a lip 2270, which is approximately 4 inches high and is hinged to top wall 2274. Side walls 2220 and 2230 are wider than bottom wall 2240, and are tapered at their lower ends to join bottom wall 2240. Upper lip 2270 may be attached to top wall 2274 by a hinge spanning all or part of an edge 2272 between top wall 2274 and lip 2270. Alternatively, lip 2270 may be hinged to side walls 2220 and 2230. Box 2100 may be any suitable size, and may be constructed from any suitable material. For example, box 2100 may be constructed of #16 sheet metal and have a depth that exceeds the flattened width of hose in hose bundle 2280 by ¼ inch.

The size of a box of a hose pack according to the present invention (e.g., box 1500 and 2100) is determined in accordance with the volume of hose occupied by a hose bundle of the hose pack. The volume of such a box should exceed (by a margin of approximately 0%) the volume occupied by the hose when rolled up into a compact hose roll. When the hose is rolled up into an expanded hose coil, and then formed into a hose bundle, it will occupy slightly more volume than when rolled into a compact hose roll. Accordingly, such a determination ensures that a box of a hose pack has adequate volume.

Hose pack 2200 further includes hose bundle 2280, arranged in box 2100 as a plurality of hose loops (e.g. 4) of a folded-up expanded hose coil. Hose bundle 2280 expands when pressure is applied to it through coupling 2260. The first portion of hose in bundle 2280 to expand is a horizontal leg 2285. Leg 2285 leads into box 2100 through a gap 2110 (best seen in FIG. 21) between side wall 2230 and lip 2270. Leg 2285 feeds water from coupling 2260 into bundle 2280. When leg 2285 and bundle 2280 expand, upper lip 2270 is pushed out and up from the rest of box 2100.

Figure 22:
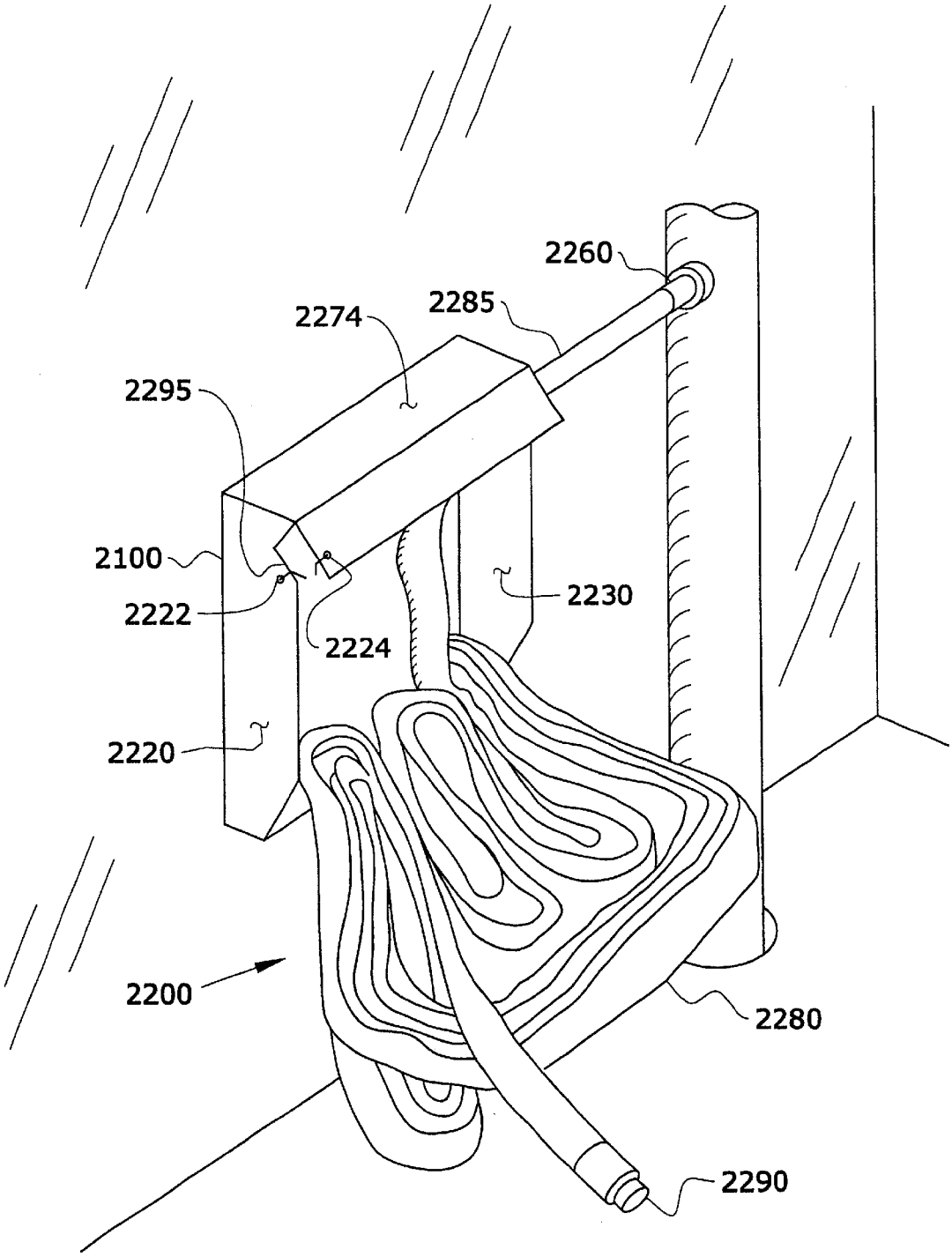
FIG. 22 is a perspective view of a hose bundle immediately after bursting out of a box according to various aspects of the present invention.

When upper lip 2270 moves in this fashion, a seal (conventionally made of thin plastic) is compromised and separates. Such a seal may be mounted in holes 2222 and 2224 on sidewall 2220 and lip 2270, respectively, as illustrated in FIG. 22.

Figure 23:
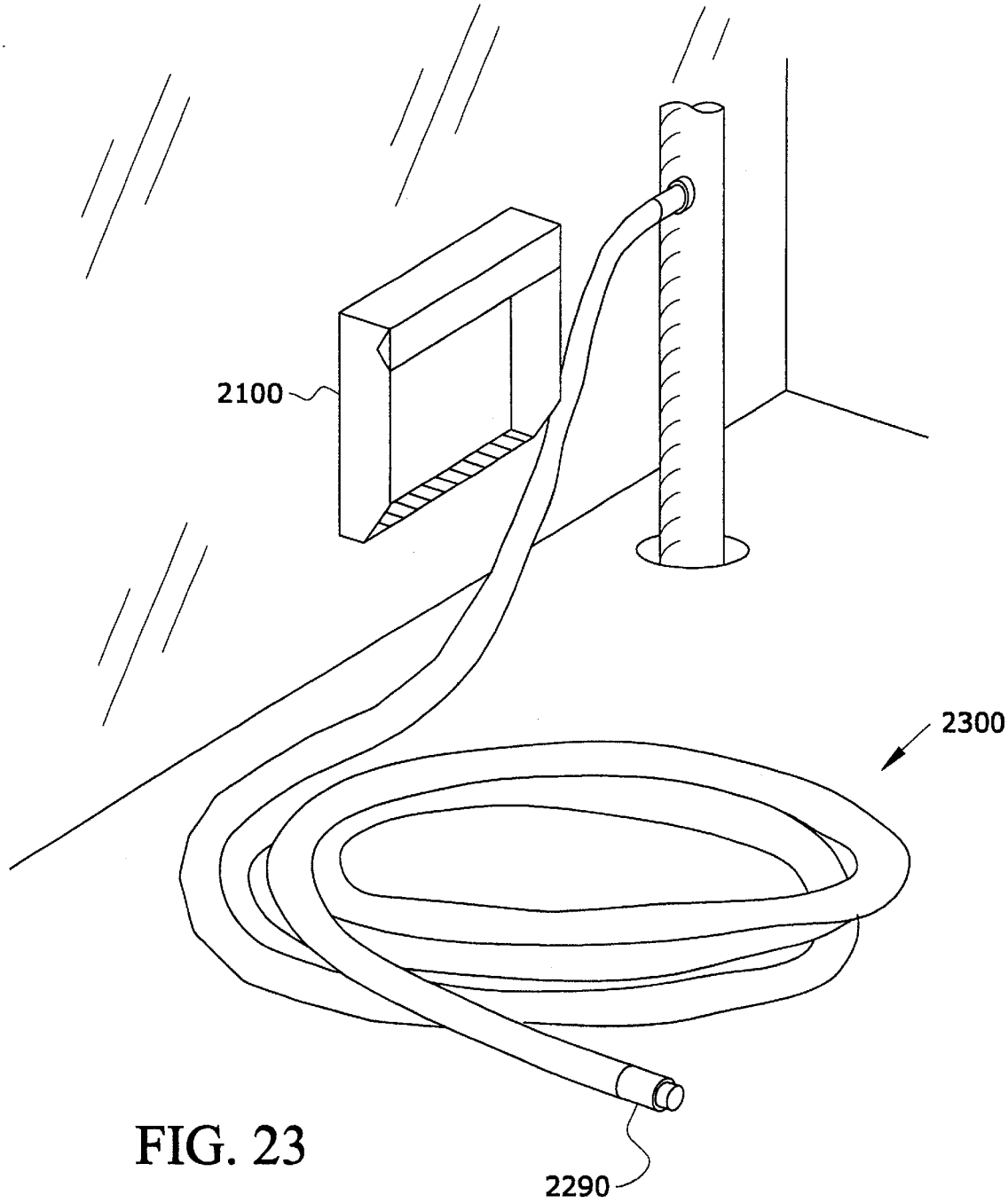
FIG. 23 is a perspective view of a pressurized hose bundle that has assumed the form of expanded hose coil according to various aspects of the present invention.

Hose bundle 2280 then further expands and falls out of box 2100 to form an expanded hose coil 2300, illustrated in FIG. 23. Coupling (suitably having a nozzle) 2290 preferably includes a conventional valve/handle (not shown) for containing water inside expanded hose coil 2300 until coupling 2290 can be aimed toward a fire. Coupling 2290 is preferably arranged so that it tends to rest on top of the expanded hose coil where it can most easily be accessed and pulled away from the coil by a person fighting a fire. For example, a short segment of hose adjacent coupling 2290 may pass through 2295 between side wall 2220 and lip 2270. In such an arrangement, coupling 2290 hangs from 2295.

In accordance with various aspects of the present invention, an accordion-folded assembly of hose, which is mounted in a pin rack of a conventional hose cabinet, may be replaced by a hose pack. To perform such a replacement, the pin rack is pointed toward the hose roller. The hose is then removed from the pin rack, one fold at a time, and rolled up into an expanded hose coil using a hose roller with extension arms, as described above. Preferably, the extension arms are adjusted to separate opposing pegs by approximately 48 inches to accommodate 1½ inch heavy duty hose, as discussed above. The expanded hose coil is then formed into a hose bundle as described above. The hose roller may be transported to the vicinity of the hose cabinet on a wheeled portable stand. The female coupling of the existing hose assembly (e.g. coupling 2260 of FIG. 22) is preferably left connected to its water source during the entire replacement process.

As discussed above, a hose pack of the present invention includes a box and a hose bundle. Such a box is installed in the hose cabinet after hose from the conventional hose cabinet has been rolled up into an expanded hose coil and then folded into a hose bundle. The hose bundle is then mounted in the box to form the hose pack, as described above. Preferably, the hose pack is located below the pin rack in the space formerly occupied by the accordion-folded hose.

Hose pack 2200 may be mounted directly to the wall of a structure, preferably near a source of pressurized water. In a variation, such a source provides pressurized water automatically when a fire is detected by a conventional fire detection system. Hose pack 2200 may be attached to (or inserted in) the wall of a structure or hose cabinet by any suitable fastener(s) or adhesive.

When a sprinkler system is activated in a particular section of a structure, an electronic signal activates the fire alarm system. This signal or related signal may be intercepted and utilized to operate an automatic water valve in which coupling 2260 is attached. Accordingly, hose bundles (such as hose bundle 2280) within a specific portion of a structure may automatically charged with water ready in position ready for use by occupants in the affected area.

Whether or not such an automatic system is installed, an occupant requiring the deployment of hose bundle 2200 before it is pressurized may pull the nozzle 2290, to break an inspector's seal between holes 2222 and 2224. This action releases lip 2270 and hose bundle 2280 falls out of box 2100. The automatic water valve (not shown) may then be manually opened to form an expanded hose coil 2300.

A method of the present invention may be used to fight a fire from a fire engine or other structure having a hose compartment with a pump discharge. In such a method, hose is formed into a hose bundle in accordance with the invention, the hose bundle having two loops which extend in opposite directions from a central point. As described above, a central point is used as a point of reference in the formation of a hose bundle from an expanded hose coil. Such a method is advantageous in that it permits a conventional long and narrow hose bed compartment of a fire engine to be used for deployment of fire hose that has already been pressurized with water while in the compartment.

According to the method, a single section of suitable fire hose, conventionally a 50 foot length of 1½ inch or 1¾ inch preconnected "attack" fire hose, is coupled to a conventional pump discharge designed for the hose bed compartment of a fire engine. The hose section is then stretched out onto the ground away from the fire engine. A separate section of hose is then formed into an expanded hose coil in accordance with the invention, as described above. The expanded hose coil is then formed into a 2-loop hose bundle in which the loops extend in opposite directions. Such a hose bundle may be alternately viewed as a single flattened loop of hose, having two 180° bins at opposite ends connected by parallel lengths of hose. A male coupling of the hose section in the hose bundle is arranged to be near one end of the center of the bundle, while a female coupling of the hose section is arranged to be outside of one end of the hose bundle.

A hose bundle is then placed in the compartment so that the collapsed hose is parallel to the floor of the compartment. When the hose is arranged in this manner, the width of the hose occupies approximately one-half of the width of the compartment.

The other section of hose, which has been stretched out to its full 50 foot length, is then doubled back twice from its male coupling end toward the fire engine. Four folds are formed from the hose. The male coupling of the folded hose is attached to the female coupling of the hose bundle. To facilitate this attachment, the hose bundle is arranged in the compartment so that its female coupling is located on the bottom side of the bundle near an open end of the compartment. After the couplings have been attached, the four folds of the 50 foot hose section are stacked onto each other to form a single unit of "accordion stacked" hose. This unit of hose is folded onto itself and loaded into the compartment adjacent the hose bundle. At this point, the unit of "accordion folded" hose rests alongside the hose bundle. When arranged in this manner, the width of the "accordion folded" unit and hose bundle occupy much of the width of the compartment. At this point, the two sections of hose are prepared for deployment in fighting a fire.

A method of the present invention for preparing to fight a fire, as described above, may be extended to a method of the invention for fighting a fire. Such a method includes any suitable steps for pressurizing the hose bundle in the hose compartment, removing a coupling from the end of the folded hose from the hose compartment, and advancing toward a fire while removing the folded hose, and then the hose bundle, from the compartment.

Preferably, a firefighter grasps two loops from the folded unit of hose in the compartment, one with each hand. The loops are then pulled out of the compartment until the entire 50 foot section of hose in the unit of folded hose has been pulled out of the compartment. The hose is allowed to fall to the floor or ground in a "V" pattern, preferably within approximately 10 feet of the fire engine. At this point, the hose bundle may be removed from the compartment and placed onto the ground near the fire engine.

In a variation of the method, a firefighter may remove the hose bundle and advance toward the fire, dropping loops from the hose bundle while advancing. However, immediate deployment of the hose bundle near the fire engine may be desired instead, for example when firefighters near the fire engine are at risk of being burned over by a rapidly advancing fire. In such a situation, time and space are often unavailable for conventional deployment of hose.

When the hose bundle is to be carried toward the fire, the firefighter inserts an arm into the hose bundle and hoists it on a shoulder. At this point (in this variation of the method), neither the 50 foot section nor the hose bundle are under pressurization. As the firefighter advances with the hose bundle toward the desired destination, he or she drops loops from the hose bundle onto the floor or ground. When the destination has been reached, the hose is pressurized.

Such a variation of the method is advantageous in that no hose needs to be laid out behind the point at which the hose is first used to fight the fire. In a further variation of the method, multiple hose bundles may be connected together and carried toward a desired destination.

In another variation, two hose bundles (each containing a 100 foot section of hose) are placed side by side (i.e. adjacent each other other) in a compartment (e.g. a preconnected fire attack hose bed of a fire engine). The first hose bundle is connected to the pump discharge, while the second hose bundle is connected to the first hose bundle. The first hose bundle is removed from the compartment and placed on the ground adjacent the fire engine. The second hose bundle is then removed and either placed on the ground adjacent the first hose bundle, (preferably within 5 feet of the fire apparatus) or is "threaded" onto the fire fighter's shoulder. When thus carried by a fire fighter, the second hose bundle is then advanced one coil loop at a time to the desired destination before being charged with water, as described above.

This variation of a method of the invention uses 200 feet of hose, 50 feet more hose than the method described above, which uses 150 total feet of hose. However, this variation requires less room to deploy hose adjacent to the fire apparatus and allows both expanded hose coils to be fully charged within 5 feet of the apparatus, if desired.

While it is preferred that a hose roller such as the preferred embodiments described above be used for the methods described above, other suitable structure may be used for rolling up hose into an expanded hose coil to be formed into a hose bundle. In addition, a hose roller in accordance with the invention need not be limited only to use in the methods of preparing to fight a fire and fighting a fire described above.

While the present invention has been described in terms of preferred embodiments and generally associated methods, it is contemplated that alterations and permutations thereof will become apparent to those skilled in the art upon a reading of the specification and study of the drawings. The present invention is not intended to be defined by the above description of preferred exemplary embodiments, or by the description present in the provisional application of which benefit is claimed. Rather, the present invention is defined variously by the appended claims. Each variation of the present invention is intended to be limited only by the recited limitations of its respective claim, and equivalents thereof, without limitation by terms not present therein.

What is claimed is:

1. A dual-mode apparatus capable of rolling up collapsed hose into either one of a compact hose roll and an expanded hose coil, the apparatus being adapted to allow use of a plurality of provided extension arms when rolling up collapsed hose into an expanded coil, the apparatus comprising:

(a) a removable crank having a handle and a forked shaft; and (b) a mounting plate rotatably mounted on a fixed support, the mounting plate having mechanical connection points for the crank and the plurality of extension arms, the crank and the fixed support being situated on opposite sides of the mounting plate;

whereby the removable crank and mounting plate are arranged to facilitate transmission of torque from the crank, through the forked shaft, to:

(1) a compact hose roll directly through a mechanical connection between the forked shaft and an end of a section of collapsed hose; and (2) an expanded hose coil through the mounting plate and the plurality of extension arms.

2. The apparatus of claim 1 further comprising:

(a) a kit that includes a plurality of available forked shafts; wherein:

(1) the forked shaft of the crank is selected from the kit of available forked shafts; and (2) each available forked shaft has a different length.

3. The apparatus of claim 1 wherein the mounting plate and the forked shaft are configured such that the forked shaft is easily removed from the vicinity of the mounting plate, bearing a compact hose roll therewith, and such that the forked shaft is easily removable from the compact hose roll.

4. The apparatus of claim 3 wherein the crank has a first handle and a second handle, the first handle providing a grip for the transmission of torque to the crank, the second handle providing a grip for additional support of a compact hose roll during removal thereof from the mounting plate.

5. The apparatus of claim 1 wherein the forked shaft is sized to accommodate hose having a flattened width of at least 10 inches.

6. The apparatus of claim 1 wherein the forked shaft is sized to accommodate a plurality of compact hose rolls placed adjacent to each other.

7. The apparatus of claim 1 wherein the forked shaft comprises a first rod and a second rod, the first rod being longer than the second rod.

8. The apparatus of claim 1 further comprising:

(a) a bearing; and (b) a ratchet mechanism, whereby the mounting plate is rotatably mounted on the fixed support through the ratchet mechanism and the rotation of the mounting plate in one direction is limited.

9. The apparatus of claim 1 further comprising a plurality of extension arms coupled to the mounting plate at a plurality of mechanical connection points.

10. The apparatus of claim 9 wherein the extension arms are coupled to the mounting plate in a releasable fashion.

11. The apparatus of claim 10 further comprising:

(a) a plurality of radial tubes dimensioned and configured to receive the extension arms therein; the tubes being mounted on the mounting plate and extending radially therefrom, and (b) a plurality of fasteners for securing the extension arms to the radial tubes in a releasable fashion.

12. The apparatus of claim 9 wherein the extension arms are dimensioned and configured to separate a plurality of opposing points of the expanded hose coil by at least about 48 inches.

13. The apparatus of claim 12 wherein the extension arms are dimensioned and configured to separate a plurality of opposing points of the expanded hose coil by at least about 58 inches.

14. The apparatus of claim 9 further comprising a plurality of hose retaining pegs, each peg being attached to a corresponding extension arm near one end of the extension arm.

15. A method for rolling up collapsed hose into either one of a compact hose roll and an expanded hose coil, the method comprising:

(a) providing a removable crank having a handle and a forked shaft;

(b) providing a mounting plate rotatably mounted on a fixed support, the mounting plate having mechanical connection points for the crank and a plurality of extension arms, the crank and the fixed support being situated on opposite sides of the mounting plate; and (c) transmitting torque from the crank, through the forked shaft, to a selected one of:

(1) a compact hose roll directly through a mechanical connection between the forked shaft and an end of a section of collapsed hose; and (2) an expanded hose coil through the mounting plate and the plurality of extension arms.

16. The method of claim 15 further comprising selecting the forked shaft of the crank from a kit that includes a plurality of forked shafts, each having a different length.

17. The method of claim 15 further comprising, in sequence:

(a) removing the forked shaft from the vicinity of the mounting plate, bearing a compact hose roll therewith; and (b) removing the forked shaft from the compact hose roll.

18. The method of claim 17 further comprising:

(a) gripping a first handle on the crank while transmitting torque to the crank; and (b) gripping a second handle on the crank during removal of the compact hose roll from the mounting plate.

19. The method of claim 15 further comprising preventing the hose roller from unwinding in response to tension from the hose being rolled up.

20. The method of claim 15 further comprising, in sequence:

(a) releasably coupling extension arms to the mounting plate; and (b) rolling up a length of collapsed hose into an expanded hose coil using the extension arms.

21. The method of claim 20 wherein coupling extension arms comprises utilizing extension arms configured such that a plurality of opposing points of the expanded hose coil are kept separated from each other by at least about 48 inches while the hose is being rolled up.

22. A system for rolling up collapsed hose into either one of a compact hose roll and an expanded hose coil, the system comprising:

(a) a removable crank having a handle and a forked shaft; and (b) mounting plate means rotatably mounted and having connection means for the crank and a plurality of extension arm means, wherein the removable crank and mounting plate means facilitate transmission of torque from the crank through the forked shaft to a selected one of:

(1) a compact hose roll directly through the forked shaft and hose; and (2) an expanded hose coil through the mounting plate means and extension arm means.

* * * * *